United States Patent [19]

Tani

[11] 4,097,284

[45] Jun. 27, 1978

[54] METHOD FOR SUPERSENSITIZING SILVER HALIDE PHOTOGRAPHIC EMULSIONS

[75] Inventor: Tadaaki Tani, Minami Ashigara, Japan

[73] Assignee: Fuji Photo Film Co., Ltd., Minami Ashigara, Japan

[21] Appl. No.: 736,047

[22] Filed: Oct. 27, 1976

Related U.S. Application Data

[63] Continuation-in-part of Ser. No. 635,546, Nov. 26, 1975, abandoned.

[30] Foreign Application Priority Data

Nov. 26, 1974 Japan ..... 49-136908
Nov. 26, 1975 Germany ..... 2553082

[51] Int. Cl.[2] ..... G03C 1/14

[52] U.S. Cl. ..... 96/126; 96/107; 96/109

[58] Field of Search ..... 96/122, 126, 107, 109

[56] References Cited

U.S. PATENT DOCUMENTS

| | | | |
|---|---|---|---|
| 3,457,078 | 7/1969 | Riester | 96/126 |
| 3,637,393 | 1/1972 | Sakamoto et al. | 96/122 |
| 3,753,719 | 8/1973 | Sakamoto et al. | 96/122 |
| 3,776,738 | 12/1973 | Ohlschlager et al. | 96/126 |
| 3,895,948 | 7/1975 | Shiba et al. | 96/126 |

*Primary Examiner*—J. Travis Brown
*Attorney, Agent, or Firm*—Sughrue, Rothwell, Mion, Zinn and Macpeak

[57] ABSTRACT

A method for spectrally sensitizing a silver halide photographic emulsion with a supersensitizing combination as hereinafter described, wherein the combination of a trimethinecyanine dye and a nitrogen-containing heterocyclic compound having a mercapto group, which is capable of producing a slightly soluble silver salt by reacting with a silver ion, is incorporated in the emulsion in a supersensitizing amount.

14 Claims, No Drawings

METHOD FOR SUPERSENSITIZING SILVER HALIDE PHOTOGRAPHIC EMULSIONS

CROSS-REFERENCE TO RELATED APPLICATIONS

This invention is a continuation-in-part of application Ser. No. 635,546, filed Nov. 26, 1975, now abandoned.

BACKGROUND OF THE INVENTION

1. Field of the Invention

The present invention relates to a method for spectrally sensitizing silver halide emulsions, and, more particularly, it is concerned with an improved method for spectrally sensitizing silver halide photographic emulsions with a supersensitizing combination of certain compounds.

2. Description of the Prior Art

In the art of preparing silver halide photographic emulsions, it has been desired to further increase the sensitivity of photgraphic emulsions. As useful methods for increasing the sensitivity of silver halide photographic emulsions, chemical sensitization and spectral sensitization are known.

In the spectral sensitization art, increased sensitivity of photographic emulsions can be attained by sensitizing dyes being incorporated in a silver halide photographic emulsion to extend the sensitive wave length region of the silver halide photographic emulsion (which intrinsically is limited to the short wave length region of visible light) to a longer wave length region of visible light. Cyanine dyes are mainly employed as such sensitizing dyes, but many other sensitizing dyes and the use thereof are known. Particularly, it is known that the combined use of not less than two kinds of sensitizing dyes, or the combined use of a certain sensitizing dye and certain compounds having no or extremely poor spectral sensitivity can impart a much more pronounced sensitizing effect than an individual sensitizing dye can impart to a silver halide photographic emulsion. Such a result is called supersensitization.

Mercapto group-containing compounds are known to be useful as antifogging agents for photographic emulsions, and it is known that they reduce the sensitivity of photographic emulsions. These facts are described, for example, in *The Theory of the Photographic Process,* third edition, page 344–346, by C. E. K. Mees & T. H. James. On the other hand, it was found, to our surprise, that the addition of a mercapto group-containing compound together with a trimethinecyanine sensitizing dye in a photographic emulsion could add a supersensitization effect to the spectral sensitizing action of the cyanine dye, rather than lower the sensitivity, whereby we reached this invention.

It is known from Japanese Patent Application No. 108,997/74 (equivalent to U.S. Ser. No. 617,752) that mercapto group-containing heterocyclic compounds increase the intrinsic sensitivity of particular silver halide photographic emulsions where most of the silver halide particles therein are made up of either silver bromide or silver chloride particles, and where the silver halide particles have a cubic crystal structure.

We have now found in accordance with the present invention, as is later described in detail, that the combined use of trimethinecyanine dyes and heterocyclic mercapto compounds in such silver halide photographic emulsions as described above can raise the intrinsic sensitivity of the emulsions more than the addition of only heterocyclic mercapto compounds.

The term "supersensitization" as hereinafter used in the present specification should be taken as including not only cases where the spectral sensitization factor (i.e., the ratio of the sensitivity in the spectral sensitization region to the sensitivity in the intrinsic sensitization region), will be appreciably enhanced, as compared to the case where one dye alone is added, but also the above-described case where the sensitivity in the intrinsic sensitization region is appreciably raised by the combined use of a certain sensitizing dye and a certain compound other than the dye, as compared to the case where each is added separately, to result in an enhancement of the sensitivity in the spectral sensitization region.

Certain sulfur compounds have long been known to be effective chemical sensitizing agents for silver halide photographic emulsions, called "sulfur sensitization". Such compounds include, for example, allythiourea, allylisothiocyanate, sodium thiosulfate, cystein and so on. However, all of these compounds are characterized by unstable sulfur therein, and they produce silver sulfide in the presence of silver ions. In order to sensitize photographic emulsions by the use of these compounds, emulsions where most of the soluble silver salts have been removed (e.g., under a pAg of not more than 9.0) are heated for an appropriate period in the presence of the compounds, ("chemical ripening"). Therefore, the "sulfur sensitization effect" was believed to arise from silver sulfide nuclei (called sensitization nuclei) formed by the reaction of silver ions in the silver halide particles with sulfur compounds.

The effect of the mercapto compounds which can be used in the practice of the present invention is different from that of such unstable sulfur-containing compounds. Namely, after an emulsion has been sulfur sensitized under the optimum condition to result in the best sensitivity that can be attained by sulfur sensitization, one or more mercapto compounds of the present invention together with one or more cyanine dyes are further added to the emulsion to result in a remarkable increase in spectral sensitization attributable to the cyanine dyes, wherein the application of heat to the emulsions (ripening) in the presence of the mercapto compound(s) is unnecessary.

It is known from Japanese Patent Application (OPI) No. 64419/74 that the spectral sensitization action of cyanine dyes which each have two heterocyclic nuclei, at least one of which is a pyridine nucleus, that is, pyridinocyanine dyes (or pyridocyanine dyes) is enhanced by the combined use of certain mercapto compounds containing acidic groups with the dyes. However, the application of the invention disclosed in that Patent Application (OPI) is confined to pyridine nucleus-containing monomethine- or trimethine-cyanine dyes, and it could not be applied to other cyanine dyes having a different structure. Moreover, each mercapto compound employed in the above invention was required to contain an acidic group bonded to an aliphatic, aryl or heterocyclic group.

SUMMARY OF THE INVENTION

We found that heterocyclic mercapto compounds which have no acidic group(s) being about supersensitization upon spectral sensitization with a wide variety of trimethinecyanine dyes, except for pyridinocyanine dyes.

It is, therefore, an object of the present invention to provide a new method for sensitizing silver halide photographic emulsions.

Another object of the present invention is to provide a new method for spectrally sensitizing silver halide photographic emulsions with a supersensitizing combination.

A further object of the present invention is to provide a method for highly spectrally sensitizing silver halide photographic emulsions and reducing fog.

The above-described objects can be attained by incorporating a certain type of nitrogen-containing heterocyclic compound, which has at least one mercapto group and can produce a slightly soluble silver salt i.e., a silver salt having less solubility in water than silver chloride, by reaction with a silver ion, together with a trimethinecyanine dye in a silver halide photographic emulsion.

DETAILED DESCRIPTION OF THE INVENTION

The mercapto group-containing heterocyclic compounds of the present invention are free of any acidic groups because slightly soluble silver salts cannot be obtained in the presence of acidic groups. For example, the heterocyclic compounds of the present invention are free of any acidic groups such as $—SO_3H$, $—SO_2H$, —COOH, $—PO_3H_2$, $—AsO_3H_2$, —CONHR, —NHCOR, $—SO_2NHR$, and $—NHSO_2R$, wherein R represents a hydrogen atom, an alkyl group or an aryl group.

The mercapto group-containing heterocyclic compounds which can be employed in the present invention contain at least one, preferably at least two, nitrogen atoms in the heterocyclic ring thereof each, and at least one carbon atom in the heterocyclic ring thereof has a mercapto group as a substituent. Preferred mercapto compounds used in the present invention are those having an acid dissociation constant pKa of 2.5 or more, preferably 3.5 to 10. The mercapto group may be formed from a thioketo group by tautomerism. The heterocyclic rings of the mercapto compounds can contain oxygen atoms, sulfur atoms and selenium atoms in addition to the nitrogen atom(s). The preferred mercapto compounds of this invention include monocyclic 5- or 6-membered heterocyclic compounds containing at least two aza nitrogen atoms, and dicyclic or tricyclic heterocyclic compounds formed by the condensation of two or three hetero rings containing at least one aza nitrogen atom in each ring therein, wherein the mercapto group is substituted on a carbon atom adjacent to an aza nitrogen atom.

The nitrogen-containing heterocyclic rings having mercapto groups which can be employed in the present invention include a 1,2,4-triazole ring, a 1,3,4-thiadiazole ring, and rings formed by linking two or three rings as described above, such as a triazolotriazole ring.

Even if these rings are present in the heterocyclic compound, it be preferred to choose the kinds and the positions of the substituent groups so that the pKa value of the resulting nitrogen-containing heterocyclic compounds having mercapto groups is 2.5 or greater.

The mercapto groups can be substituted on any carbon atom(s) in the rings, but preferably, they are substituted at a position capable of forming the following bondings:

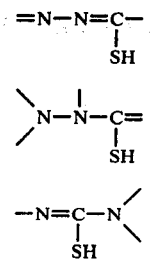

a)

b)

c)

The hetero rings used in the invention can contain substituents other than the mercapto group(s), if desired. The substituent groups include an alkyl group having up to 8 carbon atoms (e.g., methyl, ethyl, cyclohexyl, cyclohexylmethyl, etc.) which term includes a substituted alkyl group (e.g., hydroxymethyl, etc.), an alkoxy group having up to 8 carbon atoms (e.g., methoxy, ethoxy, etc.), an alkylthio group having up to 8 carbon atoms (e.g., methylthio, butylthio, etc.), a hydroxy group, an amino group, a hydroxyamino group, an alkylamino group having up to 8 carbon atoms (e.g., methylamino, butylamino, etc.), a dialkylamino group having up to 8 carbon atoms (e.g., dimethylamino, naphthylamino, diisopropylamino, etc.), an arylamino group (e.g., anilino, etc.), a halogen atom (e.g., chlorine, bromine, etc.), a cyano group and the like. Most preferred substituents are chosen from these groups so that the pKa value of the resulting compound is 3.5 or more.

The pKa value of these compound can be measured by the potentiometric titration method described in A Albert & E. P. Serjeant. *Ionization Constants of Acids and Bases,* A Laboratory Manual, 1st edition, (1962).

Specific examples of mercapto group-containing compounds which can be used in the present invention are illustrated below. The present invention is not, however, limited to the compounds specifically described below.

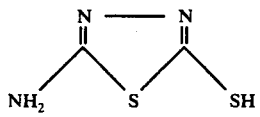

Compound (I)

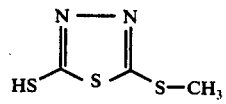

Compound (II)

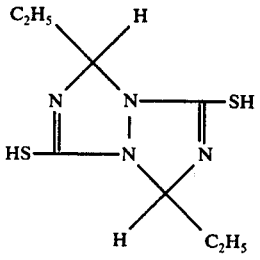

Compound (III)

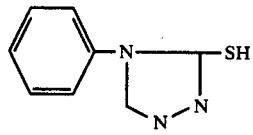

Compound (IV)

-continued

Compound (V)

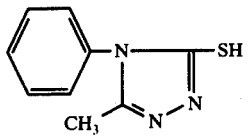

Compound (VI)

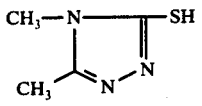

The mercapto group-containing compounds can be added in an amount sufficient to efficiently increase the sensitivity of the emulsion. They can be used in widely varying concentrations according to the conditions of emulsions. However, the mercapto group-containing compounds are preferably employed at concentrations in the range of about $1 \times 10_{-5}$ mole to about $1 \times 10^{-2}$ mole, more particularly 0.0001 to 0.0035 mole, per mole of silver halide.

These compounds may be added to emulsions in a conventional manner for additives for photographic emulsions. For example, these compounds may be dissolved in a conventional solvent which does not have a harmful effect on the finished light-sensitive materials (e.g., methanol, ethanol; acetone, etc.), and the resulting solution added to the emulsion.

The cyanine dyes which can be used in the practice of the present invention include dyes represented by the following general formula (I):

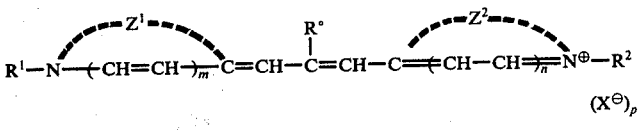

(I)

wherein $Z^1$ and $Z^2$ which may be the same or different from each other, each represents the atoms necessary to complete a 5- or a 6-membered nitrogen-containing heterocyclic ring conventionally employed in cyanine dyes.

The above heterocyclic rings include a thiazoline ring, a pyrroline ring, an oxazole ring, a thiazole ring, a selenazole ring, an imidazole ring, a tetrazole ring and the like. In addition, they can also include nuclei formed by condensing the above-mentioned rings with a benzene ring or a naphthalene ring; i.e., a benzoxazole nucleus, a naphthoxazole nucleus, a benzothiazole nucleus, a benzoselenazole nucleus, a napththoselenazole nucleus, a benzimidazole nucleus, a naphthoimidazole nucleus and so on.

These heterocyclic rings each can be substituted with an alkyl group, an alkoxy group, an aryl group, an aralkyl group, a hydroxyalkyl group, a carboxyalkyl group, an alkoxycarbonylalkyl group, a halogen atom, a carboxy group, a sulfo group, a trifluoromethyl group, an alkoxycarbonyl group, a cyano group, a hydroxy group, an alkylamino group, an alkenyl group and so on. Moreover, they may form condensed 5- or 6-membered rings by combining with an aliphatic hydrocarbon chain having 3–4 carbon atoms. (e.g., a trimethylene chain, tetramethylene chain, etc.) Any alkyl group or alkyl moieties (in the alkyl, alkoxy, aralkyl, hydroxyalkyl, carboxyalkyl, alkoxycarbonylalkyl, alkoxycarbonyl or in the alkylamino groups above carbon atoms, while preferred aryl moieties (in the aryl, aralkyl group) have 6 to 10 carbon atoms. For example, they may form a thiazole nuclei (e.g., thiazole, 4-methylthiazole, 4-phenylthiazole, 4,5-dimethylthiazole, 4,5-diphenylthiazole, etc.); a benzothiazole nuclei (e.g., benzothiazole, 4-chlorobenzothiazole, 5-chlorobenzothiazole, 6-chlorobenzothiazole, 7-chlorobenzothiazole, 4-methylbenzothiazole, 5-methylbenzothizaole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, 5-phenylbenzothiazole, etc.); a naphthothiazole nuclei (e.g., naptho [2,1-d]-thiazole, naphtho [1,2-d]thiazole, naphtho [2,3-d]thiazole, 5-methoxynaphtho [1,2-d]thiazole, 8-methoxynaptho[2,1-d]thiazole, 5-methoxy[2,3-d]thiazole, etc.); a thiazoline nuclei (e.g., thiazoline, 4-methylthiazoline, etc.); an oxazole nuclei (e.g., oxazole, 4-methyloxazole, 4-ethyloxazole, etc.); a benzoxazole nuclei (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifuluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzooxazole, etc.); a naphthoxazole nuclei (e.g., naphtho[2, 1-d]-oxazole, naphtho[1, 2-d]oxazole, naphtho[2, 3-d]oxazole, etc.); a selenazole nuclei (e.g., 4-methylselenazole, 4-phenylselenazole, etc.); a benzoselenazole nuclei (e.g., benzoselenazole, 5-chlorobenzoselenazole, 5-methoxybenzoselenazole, 5-methylbenzoselenazole, 5-hydroxybenzoselenazole, etc.); a naphthoselenazole nuclei (e.g., naphtho[2, 1-d]selenazole, naphtho[1 2-d]selenazole, etc.); an imidazole nuclei (e.g., 1-methylimidazole, 1-ethylimidazole, 1-methyl-4-phenylimidazole, 1-ethyl-4-phenylimidazole, etc.); a benzimidazole nuclei (e.g., benzimidazole, 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole, 1-ethyl-5,6-dichlorobenzimidazole, 1-ethyl-5-methoxybenzimidazole, 1-methyl-5-cyanobenzimidazole, 1-ethyl-5-cyanobenzimidazole, 1-methyl-5-fluorobenzimidazole, 1-ethyl-5-fluorobenzimidazole, 1-methyl-5-trifluoromethylbenzimidazole, 1-ethyl-5-trifluoromethylbenzimidazole, 1-allyl-5,6-dichlorobenzimidazole, 1-allyl-5-chlorobenzimidazole, 1-phenylimidazole, 1-phenylbenzimidazole, 1-phenyl-5-chlorobenzimidazole, 1-phenyl-5,6-dichlorobenzimidazole, 1-phenyl-5-methoxybenzimidazole, 1-phenyl-5-cyanobenzimidazole, etc.); a naphthoimidazole nuclei (e.g., 1-ethylnaphtho[1, 2-d]imidazole, 1-phenylnaphtho[1 2-d]imidazole, etc.); a tetrazole nuclei (e.g., 1,3-dimethyltetrazole, 1-methyl-3-ethyltetrazole, etc.) and the like.

$R^\circ$ in general formula (I) represents a hydrogen atom, an alkyl group containing up to four carbon atoms (e.g., methyl, ethyl, propyl, etc.), a hydroxyalkyl group (e.g., β-hydroxyethyl, etc.), a carboxyalkyl group (e.g., β-carboxytetoyl group, etc.), a cyano group, an aralkyl group (e.g., phenethyl, etc.), a phenyl group (which term includes a substituted phenyl group (e.g., o-carboxyphenyl, etc.)), and the like, where any alkyl moiety described above has up to 4 carbon atoms.

In the general formula (I), *m, n* and *p* each represents 0 or 1. $R^1$ and $R^2$ each represents an aliphatic group containing 1 to 8 carbon atoms or an aromatic group (e.g., a phenyl group) which can be substituted with an alkyl group having 1 to 4 carbon atoms, an alkoxy group having 1 to 4 carbon atoms, a halogen atom such as a chlorine, bromine atom etc. The aliphatic group may have its the carbon chain broken by an oxygen atom, a sulfur atom or a nitrogen atom, and may form a ring with a methine chain. Both the aliphatic and an aromatic groups can be substituted, if desired. For example, they include not only unsubstituted alkyl group containing 1 to 8 carbon atoms (e.g., methyl, ethyl, n-propyl, hexyl, etc.) but a substituted alkyl group (the alkyl moiety thereof preferably having 1 to 4 carbon atoms, e.g., vinylethyl, aralkyl such as benzyl, phenethyl, etc., hydroxyalkyl such as 2-hydroxyethyl, 3-hydroxypropyl, 4-hydroxybutyl, etc., acetoxyalkyl such as 2-acetoxyethyl, 3-acetoxypropyl, etc., alkoxyalkyl such as 2-methoxyethyl, 4-methoxybutyl, etc., hydroxysulfonyloxyalkyl such as 3-hydroxysulfonyloxypropyl, 4-hydroxysulfonyloxybutyl, etc., carboxycontaining alkyl such as 2-carboxyethyl, 3-carboxypropyl, 2-(2-carboxyethoxy)ethyl, p-carboxybenzyl, etc., a sulfo groupcontaining alkyl group such as 2-sulfoethyl, 3-sulfopropyl, 3-sulfobutyl, 4-sulfobutyl, 2-hydroxy-3-sulfopropyl, 2-(3-sulfopropoxy)ethyl, 2-acetoxy-3-sulfopropyl, 3-methoxy-2-(3-slufopropoxy)propyl, 2-[2-(3-sulfopropoxy)ethoxy]ethyl, 2-hydroxy3-(3'-sulfopropoxy)propyl, sulfo group-containing aralkyl group such as p-sulfophenethyl, p-sulfobenzyl, etc.); and an aryl group (e.g., phenyl, p-tolyl, etc.), wherein any alkyl moiety preferably has 1 to 4 carbon atoms and a preferred aryl moiety is a phenyl group, e.g., ($C_1$- $C_4$alkyl)-phenyl.

X⊖ represents an inorganic or an organic acid anion which can form a salt together with the dye, such as a chlorine ion, a bromine ion, an iodine ion, a perchloric acid ion, a p-toluenesulfonic acid ion, etc.. When the dye forms an internal salt, p is zero. In other cases, *p* is 1.

Dyes which are especially preferred among the dyes represented by general formula (I), which can be employed in the practice of the present invention, are represented by the following general formula (II):

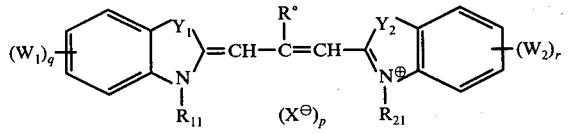

wherein $Y_1$ and $Y_2$ each represents a sulfur atom, a selenium atom, or an oxygen atom; $R_{11}$ and $R_{21}$ each represents an alkyl group, a hydroxyalkyl group, a carboxyalkyl group, a sulfoalkyl group or a sulfoalkoxyalkyl group where any alkyl moiety preferably has 1 to 8 carbon atoms; $W_1$ and $W_2$ each represents an alkyl group containing 1 to 4 carbon atoms, a phenyl group, an aralkyl group, most preferably a ($C_1$ - $C_4$ alkyl) phenyl group, an alkoxy group containing 1 to 4 carbon atoms, a hydroxy group, a halogen atom, a cyano group, a carboxy group, an alkoxycarbonyl group (the alkyl moiety thereof having up to 4 carbon atoms) or a trifluoromethyl group; *q* and *r* each represents zero or an integer ranging from 1 to 4; and R°, X⊖ and *p*, respectively, have the same meanings as in general formula (I).

The dyes which are most preferably used in the present invention among the above dyes have the following general formulae (III) - (IX):

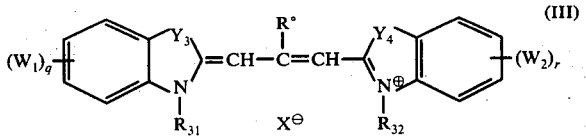

(III)

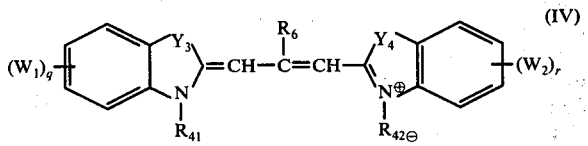

(IV)

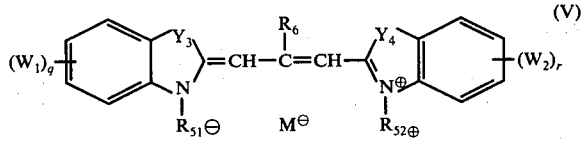

(V)

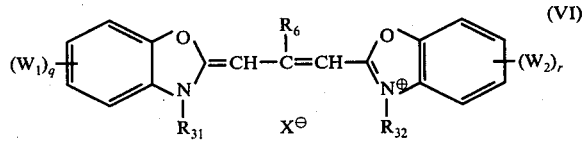

(VI)

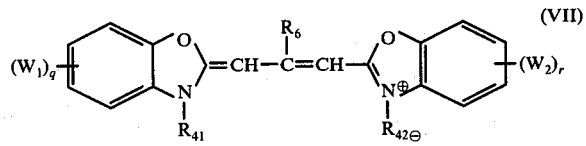

(VII)

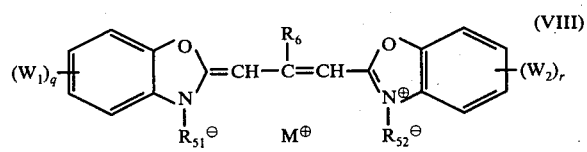

(VIII)

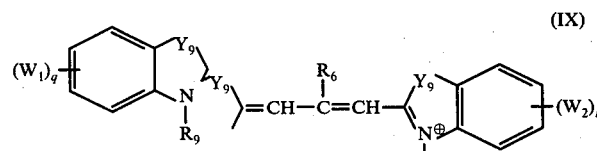

(IX)

wherein R°, $W_1$, $W_2$, X⊖, *q* and *r*, respectively, have the same meanings as in the general formula (I); $Y_3$ and $Y_4$ each represents a sulfur atom or a selenium atom; $R_{31}$, $R_{32}$ and $R_{41}$ each represents an alkyl group containing up to 4 carbon atoms; $R_{42}$, $R_{51}$ and $R_{52}$ each represents a sulfoalkyl group or sulfoalkoxyalkyl group where the sulfo group is in the form of an anion, e.g., alkyl —$SO_3$⊖ (containing up to 8 total carbon atoms); M⊕ represents a cation such as a hydrogen ion, an alkali metal ion, an ammonium ion, etc.; and $R_6$ represents a methyl or an ethyl group. The groups $R_{31}$, $R_{32}$ and $R_{41}$ are preferably an ethyl group. ω-Sulfoalkyl groups made up of straight carbon chains having 1 to 4 carbon atoms such as β-sulfoethyl, γ-sulfopropyl, δ-sulfobutyl, etc., are preferred as $R_{42}$, $R_{51}$ and $R_{52}$. An ethyl group is preferred as $R_6$. A sulfur atom is preferred as $Y_3$ and $Y_4$.

In the general formula (IX), $Y_9$ represents a sulfur atom or an oxygen atom, and $R_9$ represents a hydroxyalkyl group containing up to 4 carbon atoms (e.g., β-hydroxyethyl, γ-hydroxypropyl, etc.).

Specific examples of cyanine dyes which are useful in the present invention are given below.

Specific examples of dyes represented by the general formula (III):

3,3'-diethylthiacarbocyanine iodide,
3,3'-diethyl-9-ethyl-thiacarbocyanine iodide,
5,5'-dichloro-3,3'-diethyl-9-ethylthiacarbocyanine iodide,
5,5'-dimethyl-3,3'-diethyl-9-ethylthiacarbocyanine iodide,
5,5'-dimethoxy-3,3'-diethyl-9-ethylthiacarbocyanine iodide,
5,5'-diphenyl-3,3'-diethyl-9-ethylthiacarbocyanine iodide and the like.

While only iodides are illustrated, chlorides, bromides, perchlorates and p-toluenesulfonates of the above-mentioned substituted thiacarbocyanines are also useful.

Specific examples of dyes represented by the general formula (IV):

3-ethyl-3'-sulfoethyl-9-ethylthiacarbocyanine,
5,5'-dichloro-3-ethyl-3'-sulfoethyl-9-ethylthiacarbocyanine,
5,5'-dimethyl-3-ethyl-3'-sulfopropyl-9-ethylthiacarbocyanine,
5,5'-dimethoxy-3-ethyl-3'-sulfoethyl-9-ethylthiacarbocyanine,
5,5'-diphenyl-3-ethyl-3'-sulfoethyl-9-ethylthiacarbocyanine and the like.

Specific examples of dyes represented by the general formula (V):

3,3'-disulfopropyl-9-ethylthiacarbocyanine rhodium salt,
5,5'-dichloro-3,3'-disulfoethyl-9-ethylthiacarbocyanine sodium salt,
5,5'-dimethyl-3,3'-disulfopropyl-9-ethylthiacarbocyanine sodium salt,
5,5'-dimethoxy-3,3'-disulfopropyl-9-ethylthiacarbocyanine sodium salt,
5,5'-dipheny-3,3'-disulfoethyl-9-ethylthiacarbocyanine sodium salt, and the like.

While only sodium salts are illustrated, disulfonic acids, potassium salts, pyridinium salts and triethylammonium salts of the above described substituted thiacarbocyanines are also useful.

Specific examples of dyes represented by the general formula (VI):

3,3'-diethyl-9-ethyl-oxacarbocyanine iodide,
5,5'-dichloro-3,3'-diethyl-9-ethyloxacarbocyanine perchlorate,
5,5'-dimethyl-3,3'-diethyl-9-ethyloxacarbocyanine iodide,
5,5'-dimethoxy-3,3'-diethyl-9-ethyloxacarbocyanine iodide,
5,5'-diphenyl-3,3'-diethyl-9-ethyloxacarbocyanine p-toluenesulfonate and the like.

Specific examples of dyes represented by the general formula (VII):

3-ethyl-3'-sulfoethyl-9-ethyloxacarbocyanine,
3-propyl-3'-sulfopropyl-9-ethyloxacarbocyanine,
5,5'-dimethyl-3-ethyl-3'-sulfoethyl-9-ethyloxacarbocyanine,
5,5'-dimethoxy-3-ethyl-3'-sulfoethyl-9-ethyloxacarbocyanine,
5,5'-diphenyl-3-ethyl-3'-sulfoethyl-9-ethyloxacarbocyanine and the like.

Specific examples of dyes represented by the general formula (VIII):

3,3'-disulfoethyl-9-ethyloxacarbocyanine sodium salt,
5,5'-dimethyl-3,3'-disulfoethyl-9-ethyloxacarbocyanine sodium salt,
5,5'-dimethoxy-3,3'-disulfoethyl-9-ethyloxacarbocyanine sodium salt,
5,5'-dimethoxy-3,3'-disulfopropyl-9-ethyloxacarbocyanine sodium salt,
5,5'-diphenyl-3,3'-disulfoethyl-9-ethyloxacarbocyanine sodium salt and the like.

While one sodium salts are illustrated, disulfonic acids, potassium salts, pyridinium salts and triethylammonium salts of the above described substituted oxacarbocyanines are also useful..

Specific examples of dyes represented by the general formula (IX):

3,3'-dihydroxyethyl-9-ethylthiacarbocyanine chloride,
5,5'-dichloro-3,3'-dihydroxyethyl-9-ethylthiacarbocyanine p-toluenesulfonate,
5,5'-dimethyl-3,3'-dihydroxypropyl-9-ethylthiacarbocyanine chloride,
5,5'-dimethyl-3,3'-dihydroxypropyl-9-ethyloxacarbocyanine chloride,
5,5'-dimethoxy-3,3'-dihydroxyethyl-9-ethylthiacarbocyanine chloride,
5,5'-dimethoxy-3,3'-dihydroxyethyl-9-ethyloxacarbocyanine chloride,
5,5'-diphenyl-3,3'-dihydroxyethyl-9-ethylthiacarbocyanine p-toluenesulfonate and the like.

The cyanine dyes can be added in an amount sufficient to effectively spectrally sensitize the silver halide photographic emulsion. They can be used in widely varing concentrations according to various conditions of the emulsion. However, they are generally employed at concentrations in the range of about $10^{-6}$ mole to about $10^{-3}$ mole, more preferably $5 \times 10^{-6}$ to $1 \times 10^{-4}$ mole, per mole of silver halide.

The sensitizing dyes can be added to the emulsions by conventional techniques in this art.

These sensitizing dyes can be directly dispersed in the emulsion, or can be added to the emulsion as solutions prepared by dissolving the dye(s) in a water soluble solvent such as pyridine, methyl alcohol, ethyl alcohol, methyl cellosolve, acetone, mixtures thereof, etc., by diluting the dyes with water or by disolving the dyes in water. In addition, ultrasonic vibrations can be used to dissolve the dyes in the above solvents. Moreover, the dye(s) dissolved in a volatile organic solvent can be dispersed into a hydrophilic colloid, and the resulting dispersion added to the emulsion, as disclosed in U.S. Pat. No. 3,469,987. As disclosed in Japanese Patent Publication No. 24185/71, water insoluble dyes can be dispersed in a water soluble solvent without dissolving them therein, and the resulting dispersion added to the emulsion. Further, the dyes can be added to emulsions as a dispersion prepared by an acid dissolution-dispersion method. Besides the above methods, the dyes can also be added to the emulsion according to the methods disclosed in, for example, U.S. Pats. Nos. 2,912,345; 3,342,605; 2,996,287; 3,425,835; and so on.

A preferred molar ratio of the amount of the mercapto compound to that of the dye(s) represented by any of the above general formulae (I) to (IX) where the combination of the mercapto compound and the dye shows excellent supersensitization ranges from about 40/1 to about 1/10, preferably from 5/1 to 1/5.

Photographic emulsions which are sensitized according to the method employed in the present invention can further contain sensitizing dyes other than the dyes represented by the general formula (I) to (IX), or can contain essentially colorless compounds which are known to show a supersensitization action in such an amount that the effect obtained in the present invention is not be injured by the addition thereof. For example, the photographic emulsions employed in the present invention may contain pyrimidinylamino group or triazinylamino group-containing compounds as disclosed in, for example, U.S. Pats. Nos. 2,933,390; 3,511,664; 3,615,613; 3,615,632; 3,615,641 and so on; condensation products of aromatic organic acids and formaldehyde as disclosed in British Pat. No. 1,137,580, azaindenes or cadmium salts, etc..

Light-sensitive materials containing photographic emulsions sensitized according to the method provided by the present invention can comprise both emulsion layers spectrally sensitized by some method other than that of the present invention and spectrally unsensitized emulsion layers, simultaneously, if desired. The sequence of the emulsion layers in the light-sensitive material can be optionally chosen from widely varing combinations.

The silver halide in a photographic emulsion employed in the method of the present invention can be silver chloride, silver bromide, silver iodide, silver chlorobromide, silver iodobromide, silver chloroiobromide or mixtures thereof. Silver bromide or silver iodobromide (containing not more than 10 mole % of silver iodide) is preferred.

The silver halide photographic emulsions employed in the present invention usually contain gelatin as a binder. However, a portion or all of the gelatin can be replaced by substances which do not exert a harmful effect upon light-sensitive silver halide, such as gelatin derivatives, albumin, agar-agar, gum arabic, alginic acid, hydrophilic resins such as polyvinyl alcohol, polyvinyl pyrrolidone, acrylic acid copolymers, polyacrylamide and the like, or cellulose derivatives.

Gelatin derivatives include reaction products of the functional groups in the gelatin molecule, such as amino, imino, hydroxy and carboxy groups, with reagents containing at least one functional group reactive with one of the above functional groups of gelatin, and graft polymers prepared by bonding the molecular chain(s) of another macromolecular compound onto gelatin.

The silver halide emulsions which are employed in the present invention may be either coarse or finely divided particles of silver halide. Further, they may contain both coarse and finely divided particles of silver halide. The silver halide particles may be prepared according to known methods for example, a single jet method, a double jet method, or a controlled double jet method.

Further, the silver halide grains in the emulsions may have a homogeneous crystal structure of a layer-like structure wherein the crystal structure in the inner shell of the grains is different from the crystal structure in the outer shell. Moreover, the grains may have a conversion type crystal structure, as disclosed in British Pat. No. 635,841 and U.S. Pat. No. 3,622,318. In addition, silver halide emulsions where a latent image is mainly formed on the surface of the silver halide grain, or an internal latent image type where a latent image is formmed in the inner part of the silver halide grain may be used to the present invention. These photographic emulsions are described in texts such as The Theory of the Photographic Process, by Mees, MacMillan Publisher; and Photographic Chemistry, by Glafkides, Fountain Press Publisher. They can be prepared by conventional methods such as an ammoniacal method, a neutral method, an acidic method and so on.

The preferred mean diameter of the silver halide grains employed in the present invention (measured by, e.g., a projected area method of a number average method) is from about 0.04 micron to about 2 microns, though the mean diameter is not limited to these values. The distribution of the grain size (grain size refers to the above) may be narrow or wide.

The silver halide emulsions may be physically ripened, if desired. After the formation of precipitates of the silver halide grains or physical ripening of the silver halide grains, soluble salts are generally removed from the emulsion. As useful means for removing soluble salts, noodle washing as is well known or a flocculation method which uses inorganic salts containing polyvalent anions (e.g., ammonium sulfate, etc.), anionic surface active agents, polystyrene sulfonic acid and other anionic polymers, or gelatin derivatives such as aliphatic- or aromatic-acyloylated gelatins can be used.

The silver halide emulsion used in the present invention emulsions need not be chemically sensitized (emulsions not afterripened) but they can be chemically sensitized, if desired. As chemical sensitization techinques, the techniques described in Mees, supra, Glafkides, supra, or H. Frieser, Die Grundlagen der Photographische Prozesee mit Silver halogeniden, Akademische Verlagsgesellschaft (1968), and other known techniques may be employed, e.g., sulfur sensitization using compounds containing sulfur reactive to silver ions such as thiosulfates, compounds as disclosed in U.S. Pats. Nos. 1,574,944; 2,278,947; 2,410,689; 3,189,458 and 3,501,313; French Pat. No. 2,059,245; and so on, or active gelatin, gold sensitization using gold complexes as disclosed in U.S. Pat. No. 2,399,083, gold thiosulfate complexes and so on, sensitization with noble metals such as platinum, palladium, iridium, rhodium, ruthenium, etc., as disclosed in U.S. Pats. Nos. 2,448,060; 2,540,086; 2,566,245 and 2,566,263, and so on can be employed individually or in combination. In addition, selenium sensitization can be employed instead of or in combination with sulfur sensitization, as disclosed in U.S. Pat. No. 3,297,446.

In photographic emulsions which have already been sensitized by various sensitization techniques employed in the present invention, a wide variety of compounds can be added to prevent the light-sensitive materials from fogging in the course of manufacture, on storage or during developing, or to stabilize photographic functions. For example, the antifogging agents disclosed in U.S. Pat. No. 2,394,198, Japanese Patent Publication No. 4136/68; U.S. Pat. No. 2,691,588; British Pat. No. 623,488 and Japanese Patent Publications Nos. 4941/68 and 13496/68 can be used.

In order to increase the sensitivity and the contrast, or to accelerate the developing speed, photographic emulsions sensitized in accordance with this invention may contain, for example, compounds as disclosed in U.S. Pat. No. 2,708,161; British Pat. No. 1,145,186; Japanese Pat. Publications Nos. 10989/70; 15188/70; 43435/71; 8106/72 and 8742/72; U.S. Pat. No. 772,021; Japanese Patent Publications Nos. 27037/70; 23465/65; 45541/72; 26471/70 and 27670/70; and so on.

The photographic emulsions of the present invention may contain inorganic or organic mercury compounds as disclosed in U.S. Pats. Nos. 2,728,664; 2,728,667; 2,728,663; 2,732,302; 2,728,665 and 3,420,668 to sensitize or prevent fogging, if desired.

To the photographic emulsions of the present invention conventional additives which possess a characteristic property to improve the quality of the photographic light-sensitive materials, for example, hardening agents, coating assistants, plasticizers, emulsion polymerization latexes, antistatic agents, ultraviolet absorbants, antioxidants and so on, may be added, if desired, as described in detail below.

The photographic emulsions sensitized in accordance with the present invention can be hardened by adding conventionally used hardeners thereto. As a hardening agent, compounds as disclosed in, for example, U.S. Pat. No. 1,870,354; British Pat. Nos. 825,544 and 676,628; U.S. Pat. No. 3,380,829; Japanese Patent Publication No. 38713/71; U.S. Pat. Nos. 3,047,394 and 3,091,537; Japanese Patent Publication No. 7133/59; U.S. Pat. Nos. 3,325,287 and 2,080,019; Japanese Patent Publication No. 1872/71; U.S. Pat. No. 2,726,162; U.S. Pat. No. 2,725,295; Japanese Patent Publications Nos. 4212/58 and 8790/62; U.S. Pat. No. 2,579,871; German Pat. No. 872,153; U.S. Pat. Nos. 3,255,000 and 3,635,718; British Pat. No. 994,869; German Pat. No. 1,090,427; U.S. Pat. No. 2,992,109; U.S. Pat. No. 3,103,437; U.S. Pat. No. 3,100,704; U.S. Pat. Nos. 3,321,313 and 3,543,292; Japanese Patent Publication No. 6899/66; U.S. Pat. No. 3,057,723; and Japanese Patent Publication No. 12550/67; or inorganic hardeners such as chrome alum, chrome acetate, zirconium sulfate, etc., can be employed individually or as a combination thereof.

To the photographic emulsions sensitized in accordance with the present invention known various surface active agents can be added as a coating assistant, or with the intention of providing anti-static properties, improving the lubricity and for other purposes. For example, nonionic surface active agents such as saponin, polyethylene glycol, condensation products of polyethylene glycol and polypropylene as disclosed in U.S. Pat. No. 3,294,540; polyalkylene glycol ethers, esters and amides as disclosed in U.S. Pat. No. 2,240,472 and 2,831,766; and so on: anionic surface active agents such as alkylcarbonates, alkylnaphthalene sulfonates, alkylsulfuric acid esters, N-acyloylated-N-alkyltaurine as disclosed in U.S. Pat. No. 2,739,891; maleopimalates as disclosed in U.S. Pat. Nos. 2,409,930 and 2,447,750; compounds as disclosed in U.S. Pat. Nos. 2,823,123 and 3,415,649; and so on: and amphoteric surface active agents such as compounds as disclosed in British Pat. No. 1,159,825; Japanese Patent Publication No. 378/65; Japanese Patent Laid-Open No. 43924/73; and U.S. Pat. No. 3,736,683 can be employed.

The photographic emulsions sensitized in accordance with the present invention may contain plasticizers such as glycerine, diols as disclosed in U.S. Pat. No. 2,960,404; trihydric aliphatic alcohols as disclosed in U.S. Pat. No. 3,520,694; and so on.

The photographic emulsions sensitized in accordance with the present invention may contain water insoluble or slightly soluble synthetic polymer dispersions with the intention of improving the dimensional stability thereof and the like. For example, polymers containing as monomer components alkyl(meth)acrylate, alkoxy(meth)acrylate, glycidyl(meth)acrylate, (meth)acrylamide, vinyl acetate, acrylonitrile, olefins, styrene and so on, individually or in combination, or the combinations of acrylic acid, $\alpha,\beta$-di-unsaturated carboxylic acids, sulfoalkylacrylates, styrene sulfonic acid or the like with the above monomers can be employed for preparing the above polymer dispersions. Specific examples of such polymers include the polymers as disclosed in U.S. Pat. Nos. 2,376,005; 3,607,290 and 3,645,740; British Pat. Nos. 1,186,699 and 1,307,373; and U.S. Pat. Nos. 3,062,674; 2,739,137; 3,411,911; 3,488,708; 3,635,715 and 2,853,457.

In addition, irradiation-scattering preventing dyes, for example, compounds as disclosed in Japanese Patent Publications Nos. 20389/66, 3504/68 and 13168/68; U.S. Pat. Nos. 2,697,037; 3,423,207 and 2,865,752; British Pat. Nos. 1,030,392 and 1,100,546; and so on, can optionally be employed, if desired.

In photographic emulsions sensitized in accordance with the present invention conventionally employed non-diffusible color image-forming couplers may be present. Such compounds capable of forming dyes by reacting with the oxidation product of an aromatic primary amine developing agent in photographic development are referred to as color image-forming couplers (abbreviated as couplers hereinafter).

As such couplers, four equivalent or two equivalent diketomethylene series yellow couplers as disclosed in, for example, U.S. Pat. Nos. 3,277,157; 3,415,652; 3,447,928; 3,311,476 and 3,408,194; U.S. Pat. Nos. 2,875,057; 3,265,506; 3,409,439; 3,551,155 and 3,551,156; German OLS Nos. 1,956,281 and 2,162,899; Japanese Patent Laid-Open Nos. 26133/72 and 66836/73; and so on can be used; four equivalent or two equivalent pyrrazolone series magenta couplers and indazolone series magenta couplers, for example, compounds as disclosed in U.S. Pat. Nos. 2,600,788; 2,983,608; 3,006,759; 3,062,653; 3,214,437; 3,253,924; 3,419,391; 3,419,808; 3,476,560 and 3,582,322; Japanese Patent Publication No. 20636/70; Japanese Patent Laid-Open No. 26133/72; and so on can be used; and $\alpha$-naphitol series cyan couplers and phenol series cyan couplers, for example, compounds as disclosed in U.S. Pat. Nos. 2,474,293; 2,698,794; 3,034,892; 3,214,437; 3,253,924; 3,311,476; 3,458,315 and 3,591,383; Japanese Patent Publications Nos. 11304/67 and 32461/69; and so on can be employed. In addition, DIR couplers or DIR compounds as disclosed in U.S. Pat. Nos. 3,227,554; 3,148,062; 3,297,445; 3,253,924; 3,311,476; 3,379,529; 3,516,831; 3,617,291; 3,705,801 and 3,632,345; German OLS No. 2,163,811; and the like can also be used. The couplers can be dispersed in the emulsions according to the methods disclosed in, for example, U.S. Pat. No. 2,801,171 and so on.

The photographic emulsion of the present invention along or in a combination with other hydrophylic colloids can be coated on a support in a conventional manner, e.g., dip-coating, air knife-coating, roller-coating, curtain-coating and extrusion-coating. The method as disclosed in U.S. Pat. No. 2,681,294 is one very advantageous method. Two or more layers can be coated simultaneously using the technique disclosed in U.S. Pat. Nos. 2,761,791 and 3,526,528; and so on.

The supports which can be used in the present invention are conventional and include transparent or opaque materials usually employed in photographic elements, for example, a glass plate; films of a synthetic polymer such as polyalkyl(metha)acrylate, polystyrene, polyvinyl chloride, partially formalated polyvinyl alcohol, polyesters such as polycarbonate or polyethylene terephthalate, polyamides, etc.; films of cellulose derivatives such as cellulose nitrate, cellulose acetate, cellulose acetate butyrate, etc., paper, baryta paper, paper coated by an $\alpha$-olefin polymer or the like, synthetic paper composed of polystyrene or the like, earthenware, metal and so on.

The photographic emulsions of the present invention can be subjected to photographic processing by conventional methods. Temperatures for treatments lower than 18° C, in the range of 18° C to 50° C or above 50° C, can be used.

The light-sensitive materials of the present invention can be subjected to conventional silver image-forming processing (monochromatic) or to color treatments (comprising color image forming).

The present invention will now be illustrated in greater detail by several examples.

EXAMPLE 1

A silver bromide photographic emulsion was prepared using a conventional double-jet method. The silver bromide grains in the emulsion had a mean diameter of 0.7 micron and a cubic crystal structure. In more detail, an aqueous solution of silver nitrate and an aqueous solution of potassium bromide were simultaneously added to a water solution of gelatin while stirring so that the silver ion concentration in the gelatin solution was constant. The emulsion contained 0.38 mole of silver bromide and about 45 g of gelatin per 1 Kg. 2000 g of this emulsion was weighed out, and 6.7 ml of a 1% by weight aqueous solution of sodium thiosulfate (pentahydrate) was added thereto. After ripening at 50° C for one hour, the resulting emulsion was sulfur sensitized.

One hundred portions of this emulsion were weighed out. To each emulsion portion were added a varying amount of a 0.1% methanol solution of 3,3'-diethyl-9-methyl-thiacarbocyanine bromide (Dye-1) and $10^{-2}$ mole/liter methanol solutions of various mercapto compounds as shown in Table 1. Each of the thus finished emulsion portions was applied to a cellulose triacetate film base having a gelatin subbing layer to a dry thickness of about 4 microns and then dried. Light-sensitive material samples were thus obtained.

Each of these samples was wedge-wise exposed for ten seconds using a tungsten lamp (having a color temperature of 2854° K; 1000 lux at surface of sample) covered by a colored filter. As a blue filter, gelatin filter-BPN-45 made by the Fuji Photo Film Co., Ltd., (transmitting light in the range of about 400 nm to 500 nm; maximum transmittance of 40% at 450 nm.) was used. As a yellow filter (minus blue filter), the glass filter made by the Tokyo Shibaura Electric Co., Ltd. (transmitting light having wavelengths longer than about 490 nm; that is, transmitting about 10% of light of 500 nm, about 73% of light of 520 nm and 80 to 90% of light having a longer wavelength than 540 nm was used. The thus exposed samples were development-processed at 20° C for 10 minutes using a Metol ascorbic acid developing solution prepared from 2.5 g of Metol 10 g of ascorbic acid, 1.0 g of potassium bromide and 35.0 g of Kodalk (or Nabox) by adding the same to water to make one liter (pH 9.8). The density was measured using an automatic recording densitometer (made by the Fuji Photo Film Co., Ltd.). Sensitivity was expressed by the reciprocal of the exposure amount necessary to obtain a density of fog +0.1. The results are shown in Table 1, where blue sensitivity and minus blue sensitivity are the relative sensitivities obtained using the above blue filter and yellow filter (minus blue filter), respectively.

Table 1

| Test No. | Dye-1 Amount Used (millimol/mol AgBr) | Mercapto Compound | Mercapto Compound Amount Used (millimol/mol AgBr) | Minus Blue Sensitivity (relative value) |
|---|---|---|---|---|
| 1 | 0 | — | 0 | 0 |
| | 0.23 | — | 0 | 100 |
| | 0.35 | — | 0 | 100 |
| 2 | 0 | (I) | 0.67 | 0 |
| | 0.23 | (I) | 0.67 | 173 |
| | 0.35 | (I) | 0.67 | 289 |
| 3 | 0 | (II) | 0.67 | 0 |
| | 0.23 | (II) | 0.67 | 296 |
| | 0.35 | (II) | 0.67 | 317 |
| 4 | 0 | (II) | 1.3 | 0 |
| | 0.23 | (II) | 1.3 | 1067 |
| | 0.35 | (II) | 1.3 | 1260 |
| 5 | 0 | (III) | 0.34 | 0 |
| | 0.23 | (III) | 0.34 | 157 |
| | 0.35 | (III) | 0.34 | 219 |
| 6 | 0 | (III) | 0.67 | 0 |
| | 0.23 | (III) | 0.67 | 270 |
| | 0.35 | (III) | 0.67 | 315 |
| 7 | 0 | (III) | 1.3 | 0 |
| | 0.23 | (III) | 1.3 | 225 |
| | 0.35 | (III) | 1.3 | 315 |
| 8 | 0 | (IV) | 0.67 | 0 |
| | 0.23 | (IV) | 0.67 | 200 |
| | 0.35 | (IV) | 0.67 | 306 |
| 9 | 0 | (IV) | 1.3 | 0 |
| | 0.23 | (IV) | 1.3 | 258 |
| | 0.35 | (IV) | 1.3 | 517 |
| 10 | 0 | (V) | 0.67 | 0 |
| | 0.23 | (V) | 0.67 | 156 |
| | 0.35 | (V) | 0.67 | 358 |
| 11 | 0 | (V) | 1.3 | 0 |
| | 0.23 | (V) | 1.3 | 100 |
| | 0.35 | (V) | 1.3 | 292 |
| 12 | 0 | (VI) | 0.67 | 0 |
| | 0.23 | (VI) | 0.67 | 334 |
| 12 | 0.35 | (VI) | 0.67 | 453 |
| 13 | 0 | (VI) | 1.3 | 0 |
| | 0.23 | (VI) | 1.3 | 531 |
| | 0.35 | (VI) | 1.3 | 694 |

It is apparent from Table 1 that the silver bromide emulsion containing cubic grains having a mean diameter of 0.7 $\mu$ had a remarkably increased sensitivity in the spectrally sensitized region due to the combinations of Dye-1 and the various mercapto compounds contained therein.

EXAMPLE 2

A photographic light-sensitive material was prepared as in Test No. 4 of Example 1 except that 5,5'-dichloro-3,3'-diethyl-9-ethylthiacarbocyanine p-toluenesulfonate (Dye-2), 5,5'-diphenyl-3,3'-diethyl-9-ethyloxacarbocyanine iodide (Dye-3) and anhydro-5,5'-dichloro-3,3'-di(3-sulfopropyl)-9-ethyloxacarbocyanine hydroxide (Dye- 4) were added to the emulsion instead of Dye-1 as used in Example 1 in the amount as shown in Table 2, respectively.

The sensitivity values obtained by carrying out the same coating and sensitometry procedures as in Example 1 are shown in Table 2 below.

Table 2

| Test No.* | Dyes (m-mol/ mol AgBr) | | Mercapto Compound II (m-mol/ mol AgBr | Minus Blue* Sensitivity (relative value) |
|---|---|---|---|---|
| 14-1 | Dye-2 | 0.23 | 0 | 100 |
| 14-2 | " | " | 1.3 | 1420 |
| 15-1 | Dye-3 | 0.35 | 0 | 100 |
| 15-2 | " | " | 1.3 | 1630 |
| 16-1 | Dye-4 | 0.35 | 0 | 100 |
| 16-2 | " | " | 1.3 | 4920 |

*Minus blue sensitivity of the emulsion sensitized with each dye in the absence of Mercapto Compound II is taken as 100 in each series of tests.

While the invention has been described in detail and with reference to specific embodiments thereof, it will be apparent to one skilled in the art that various changes and modifications can be made therein without departing from the spirit and scope thereof.

What is claimed is:

1. A method for spectrally sensitizing a silver halide photographic emulsion, which is characterized by the presence of the combination of (1) a trimethinecyanine dye of formula (II):

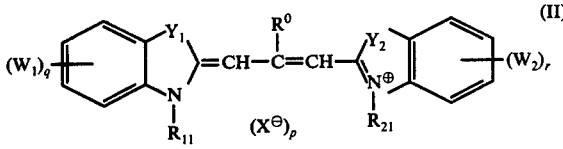

(II)

wherein $Y_1$ and $Y_2$ each represents a sulfur atom, a selenium atom, or an oxygen atom; $R_{11}$ and $R_{21}$ each represents an alkyl group, a hydroxyalkyl group, a carboxyalkyl group, a sulfoalkyl group or a sulfoalkoxyalkyl group where any alkyl moiety has 1 to 8 carbon atoms; $W_1$ and $W_2$ each represents an alkyl group containing 1 to 4 carbon atoms, a phenyl group, an aralkyl group, an alkoxy group containing 1 to 4 carbon atoms, a hydroxy group, a halogen atom, a cyano group, a carboxy group, an alkoxycarbonyl group, the alkyl moiety thereof having up to 4 carbon atoms, or a trifluoromethyl group; $q$ and $r$ each represents zero or an integer ranging from 1 to 4; $R^0$ represents a hydrogen atom, an alkyl group containing up to 4 carbon atoms, a hydroxyalkyl group, a carboxyalkyl group, a cyano group, an aralkyl group or a phenyl group; $p$ represents 0 or 1 and $X^{\ominus}$ represents an inorganic or organic acid anion which forms a salt together with the dye moiety, wherein when the dye moiety forms an internal salt $p$ is 0 and in other cases $p$ is 1, and (2) a nitrogen-containing heterocyclic compound free of any acidic groups and having at least one mercapto group, which is capable of producing a silver salt which is less soluble in water than silver chloride upon reaction with silver ion, the combination being present in said emulsion in a supersensitizing amount, said heterocyclic compound comprising a heterocyclic ring selected from the group consisting of a 1, 2, 4-triazole ring, a 1, 3, 4-thiadiazole ring and a triazolotriazole ring, said nitrogen-containing heterocyclic compound having an acid dissociation constant pKa of 3.5 or more.

2. The method of claim 1, wherein the amount of said nitrogen-containing heterocyclic compound free of any acidic groups is from about $10^{-5}$ mol to about $10^{-2}$ mol per mol of silver halide.

3. The method of claim 1, wherein the amount of said heterocyclic compound is $10^{-3}$ mol to 0.0035 mol per mol of silver halide.

4. The method of claim 2, wherein the ratio of said nitrogen-containing heterocyclic compound free of any acidic groups to the trimethinecyanine dye of formula (I) (molar) is from about 40/1 to about 1/10.

5. The method of claim 4, wherein said ratio is 5/1 to 1/5.

6. The method of claim 1, wherein said nitrogen-containing heterocyclic compound has an acid dissociation constant pKa Of 3.5 to 10.

7. The method of claim 1, wherein said nitrogen-containing heterocyclic compound has the formula:

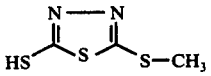

8. The method of claim 1, wherein said nitrogen-containing heterocyclic compound has the formula:

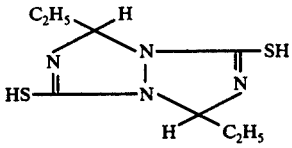

9. A photographic light-sensitive element comprising a support carrying thereon a least one silver halide photographic emulsion which comprises a supersensitizing amount of a combination of (1) a trimethinecyanine dye of formula (II):

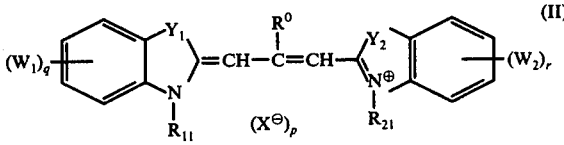

(II)

wherein $Y_1$ and $Y_2$ each represents sulfur atom, a selenium atom, or an oxygen atom; $R_{11}$ and $R_{21}$ each represents an alkyl group, a hydroxyalkyl group, a carboxyalkyl group, a sulfoalkyl group or a sulfoalkoxyalkyl group where any alkyl moiety has 1 to 8 carbon atoms; $W_1$ and $W_2$ each represents an alkyl group containing 1 to 4 carbon atoms, a phenyl group, an aralkyl group, an alkoxy group containing 1 to 4 carbon atoms, a hydroxy group, a halogen atom, a cyano group, a carboxy group, an alkoxycarbonyl group, the alkyl moiety thereof having up to 4 carbon atoms, or a trifluoromethyl group; $q$ and $r$ each represents zero or an integer ranging from 1 to 4; $R^0$ represents a hydrogen atom, an alkyl group containing up to 4 carbon atoms, a hydroxyalkyl group, a carboxyalkyl group, a cyano group, an aralkyl group or a phenyl group; $p$ represents 0 or 1 and $X^{\ominus}$ represents an inorganic or organic acid anion which forms a salt tOgether with the dye moiety, wherein when the dye moiety forms an internal salt $p$ is 0 and in other cases $p$ is 1, and (2) a nitrogen-containing heterocyclic compound free of any acidic groups and having a least one mercapto group, which is capable of producing a silver salt which is less soluble in water than silver chloride upon reaction with silver ion, the combination being present in said emulsion in a supersensitizing amount, said heterocyclic compound comprising a heterocyclic ring selected from the group consisting of a 1, 2, 4-triazole ring, a 1, 3, 4-thiadiazole ring and a triazolotriazole ring, said nitrogen-containing heterocyclic compound having an acid dissociation constant pKa of 3.5 or more.

10. The element of claim 9 wherein said nitrogen-containing heterocyclic compound has an acid dissociation constant pKa of 3.5 to 10.

11. The element of claim 10, wherein the amount of said nitrogen-containing heterocyclic compound is from about $10^{-5}$ mol to about $10^{-2}$ mol per mol of silver halide.

12. The element of claim 11, wherein the ratio of said nitrogen-containing heterocyclic compound to the trimethine cyanine dye of formula (II) (molar) is from about 40/1 to about 1/10.

13. The element of claim 9, wherein said nitrogen-containing heterocyclic compound has the formula:

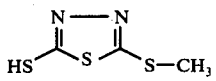

14. The element of claim 9, wherein said nitrogen-containing heterocyclic compound has the formula:

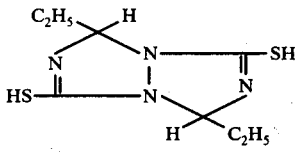

* * * * *